United States Patent [19]

Eastman et al.

[11] 4,230,173

[45] Oct. 28, 1980

[54] CLOSELY COUPLED TWO PHASE HEAT EXCHANGER

[75] Inventors: George Y. Eastman, Lancaster; Donald M. Ernst, Leola, both of Pa.

[73] Assignee: Thermacore, Inc., Lancaster, Pa.

[21] Appl. No.: 939,802

[22] Filed: Sep. 5, 1978

[51] Int. Cl.[3] ..... F28D 15/00

[52] U.S. Cl. ..... 165/1; 165/40; 165/105; 165/107 R; 165/134 DP; 165/DIG. 12

[58] Field of Search ..... 165/105, 134 DP, 40, 165/107, 1, DIG. 12

[56] References Cited

U.S. PATENT DOCUMENTS

| | | | |
|---|---|---|---|
| 2,072,486 | 3/1937 | Smith | 165/105 X |
| 3,609,991 | 10/1971 | Chu et al. | 62/119 X |
| 4,044,820 | 8/1977 | Nobles | 165/107 X |
| 4,137,965 | 2/1979 | Fallon, Jr. et al. | 165/134 DP X |

*Primary Examiner*—Albert W. Davis

*Attorney, Agent, or Firm*—Martin Fruitman

[57] ABSTRACT

A closely coupled two phase heat exchanger. The heat is transferred between gas streams by multiple intermediate fluid paths. Each of the several intermediate fluid paths passes alternately between the hot and the cold gas stream many times during its travel from the pump. The heat exchanger is designed so that the intermediate fluid vaporizes in the hot and condenses in the cold section each time, thereby minimizing the quantity of liquid necessary to transfer the heat. The pumping action for the intermediate fluid exchanger is accomplished by either mechanical or vapor pumps. An added feature of the heat exchanger is automatic control of the minimum temperature to which the hot gas is cooled. This is accomplished by shutting off one of several intermediate fluid paths at the cool end of the gas being cooled. The shutoff is accomplished either on the basis of temperature of the cooled gas or on the formation of condensates at the cool end of the gas flow path.

13 Claims, 2 Drawing Figures

CLOSELY COUPLED TWO PHASE HEAT EXCHANGER

BACKGROUND OF THE INVENTION

It has been a long standing goal of industry to reclaim the heat escaping up the stack from furnaces used both in production processes and in generating electricity. Since direct use of the flue gases is impractical because of their chemically active or toxic components, most devices attempting this goal have used gas to gas heat exchangers where the flue gases heat incoming air which can be used either as combustion air or for other purposes such as heating buildings. Because the mechanics of the combustion processes producing the flue gases often require a free flow of these gases, it has frequently been necessary to use an intermediate heat transfer system to remove the heat from the flue gases in order to prevent interference with flue gas flow. Use has been made of both banks of individual heat pipes and conventional liquid-filled tube heat exchangers to serve as the intermediate heat exchange system. U.S. Pat. No. 4,044,820 by Nobles is one of the more recent approaches to the problem. Nobles uses a closely coupled heat exchanger in which a single pass through the hot gas is immediately followed by a pass through the cold gas and this sequence is repeated several times throughout the path of the intermediate liquid. While the closely coupled heat exchanger is desirable for its effectiveness, the Nobles approach leaves several other problems unsolved.

One problem which has been under attack is that of the danger of cooling the hot gas to the point of condensing some of the corrosive chemicals in it and thereby damaging the apparatus. The general approach to this problem has been to heat the incoming air by some means, simply increasing the temperature to which the hot gas is ultimately cooled. One patent that shows this approach is the U.S. Pat. No. 2,854,220 by Vaughan. The problem with heating the incoming air is that it reduces the amount of heat recovered by the heat exchanger regardless of whether condensation is a problem or not.

A further problem with the prior art is the lack of accomodation for normal required maintenance and emergency repairs. In the Nobles system for instance, a leak anywhere in the system requires shut-down of the entire system and maintenance cannot be performed until the entire furnace is shut down. In many installations, this can mean a long period of operation without the use of the flue gas heat exchanger, simply because of some minor fault in the heat exchanger.

It is an object of the present invention to furnish a highly effective heat exchanger for flue gas-to-air heat transfer and for other similar applications. Another object of this invention is to furnish a gas-to-gas heat exchanger which uses a minimum of auxiliary power for pumping the intermediate fluid. A further object is to furnish a heat exchanger which is automatically controlled to prevent condensation of corrosive flue gas vapors. Other objects of this invention are to yield a heat exchanger for which a leak or mechanical breakdown does not require shutdown of the entire unit, and for which fluid inventory and costs are minimized.

SUMMARY OF THE INVENTION

These objectives are accomplished by the use of the closely coupled two phase heat exchanger with multiple intermediate fluid paths described in the present invention. The preferred embodiment of this heat exchanger is constructed with two counter-flowing adjacent gas ducts through which an intermediate fluid enclosed within heat exchanger tubes is moved. The fluid passes alternately between the two gases several times, vaporizing in the hotter gas section and condensing in the cooler gas section, each of these passes transferring a relatively small amount of heat compared to the total heat transfer accomplished by that path of fluid flow. Several such paths are used in the heat exchanger, each one being completely independent of the others. Included in some of the paths is a control device, such as a valve or a pump which can be shut down, thus permitting the shutdown of such paths independent of all the others. A controller attached to each of these control devices and receiving information from a sensing system permits both independent and concerted control of the independent intermediate fluid paths. Sensing devices can be placed in the hot gas duct on the surface of each of the pipes carrying the several fluid paths through the ducts, and also on the duct work confining the hot gas itself. These sensing devices can be either liquid detectors or temperature sensors.

The operation of the heat exchanger is based on the use within the intermediate fluid paths, after all non-condensible gases such as air have been removed, of a fluid which evaporates at the temperatures of the hot gas and condenses at the temperature of the cool gas. This two phase operation transfers the heat between the gases in a highly effective manner with a low temperature difference, a minimum of fluid for intermediate transfer, and a minimum of auxiliary power to accomplish the heat transfer. The auxiliary power used to move the fluid through the path is considerably reduced because of reduced liquid charge which is possible because of utilization of the heat of vaporization of the intermediate fluid. Unidirectional valves can be placed within the intermediate fluid path to assure proper direction of the vapor movement, but the pressure difference produced by a pump will be sufficient in many applications. Moreover, proper design of the system under appropriate heat transfer requirements can utilize vapor pumps so that no mechanical pumping at all is required within the intermediate fluid path.

The multiple independent paths of the heat exchanger, each independently controlled by sensors within the hotter gas duct, yields two particular benefits for the system. The first benefit is the ability to automatically control the amount of cooling of the hotter gas in order to prevent condensation of corrosive chemicals. Either liquid detectors or temperature sensors on the intermediate fluid path operating nearest the cool end of the hot gas can be used to prevent condensation. Liquid detectors can shut down the intermediate fluid path operating nearest the hotter gas exit at the first sign of any condensation, or temperature sensors may be set to shut down the path as the dew point of various vapors is approached. This automatic control of detrimental condensation permits maximum utilization of the heat of the flue gases, always limited by the exact point at which problems occur, rather than limiting the heat transfer at all times as a precautionary measure.

The second benefit of the multiple path system is that it permits the shut down of one of the several paths for maintenance or because of a leak, but the system permits continued operation of the other paths, yielding only a small reduction in the effectiveness of the unit and permitting relatively efficient operation until a maintenance period is available.

DETAILED DESCRIPTION OF THE INVENTION

Figure 1:
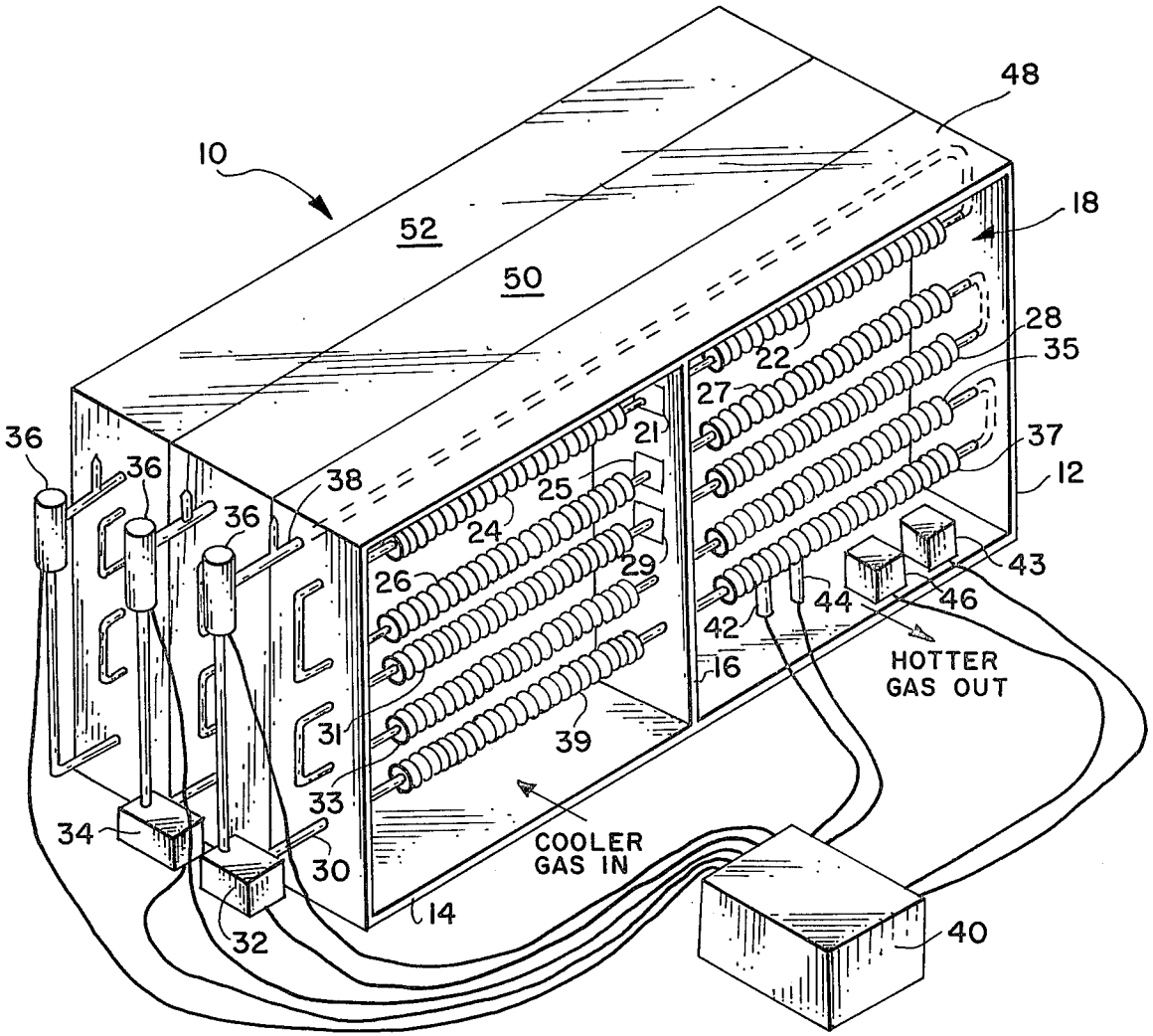
FIG. 1 is a perspective view of the invention showing one intermediate fluid path exposed at one end of the heat exchanger.

The basic concept of the invention is shown in FIG. 1 where heat exchanger 10 is constructed of two parallel ducts 12 and 14 which form passages for the flow of two gases. Barrier 16 isolates the flow of gas in the two ducts. Heat is transferred between the two gases by means of several sealed intermediate fluid paths from which non-condensible gases have been removed each contained in separate sections 48, 50 and 52. A part of path 18 within section 48 is shown at the end of ducts 12 and 14. Intermediate fluid path 18 is typically filled to less than one-third of its volume with a fluid which is in the liquid state as it enters from pump 32; is at least partially in the vapor state after heating by the hotter gas in duct 12; and returns to the liquid state by condensation as it is cooled in duct 14. In FIG. 1, finned unit 22 contains a combination of vapor and liquid, the liquid having been pumped in from previous finned units by a combination of pump pressure, vapor pressure, gravity, puddle and shear flow. Liquid in finned unit 22 is heated by the hotter gas and vaporized. The vapor pressure caused by the vaporization of the fluid in finned unit 22 forces the flow of the vapor through check valve 21 and into finned units 24 and 26. Check valve 21 between finned units 22 and 24 prevents the flow of vapor backwards from unit 24 to unit 22, but can be eliminated when the pressure differential created by pump 32 is sufficient to prevent reverse flow. The flow within path 18 continues with the condensed liquid in units 24 and 26 flowing through check valve 25 into finned units 27 and 28 where it is reheated, once more vaporized, and then flows through check valve 29. The cycle repeats once more, condensing in units 31 and 33 and vaporizing in units 35 and 37.

As the vapor cools in final finned sectin 39 of path 18, the condensed liquid is transported through pipe 30, into pump 32. Pump 32 then recirculates the liquid through valve 36 and pipe 38 into duct 14 where it re-enters path 18 and repeats the process.

Control of intermediate path 18 is accomplished by pump 32 and valve 36 in conjunction with controller 40 which responds to electrical signals from temperature sensors 42 and 43 and moisture sensors 44 and 46. When the temperatures of unit 37, as measured by temperature sensor 42, or the hotter gas as measured by sensor 43, fall below that preset temperature at which condensation may occur, or when moisture sensors 44 and 46 detect the presence of condensation, controller 40 closes valve 36 and shuts off pump 32. This action prevents any further cooling of the hotter gas by heat transfer path 18 and condensation is prevented. Any of the four sensors may be used either alone or in combination on any or all of the intermediate fluid paths in appropriate applications.

Heat exchanger 10 is constructed of multiple sections, three sections being shown in the preferred embodiment of FIG. 1, but a considerably greater number are useable in appropriate applications. Multiple sections 48, 50 and 52 of heat exchanger 10 are each completely independent of each other, essentially mechanically identical, and all independently controlled. Thus, when flow in the intermediate fluid path of section 48 is shut off, the paths in sections 50 and 52 continue to function without interruption. Moreover, the intermediate fluid paths can be filled with different fluids, to vary the temperatures of operation of each path.

Section 52 is shown constructed with only valve 36 in the heat exchanger path, and with no pump connected to it. This is possible because the energy from the hotter gas can be used to propel the intermediate fluid through the heat exchanger path, not only as discussed previously, as an adjunct to a pump, but also to totally substitute for a mechanical pump. Vapor pumps as well as mechanical pumps can be used, including designs which use heat from other portions of the apparatus.

In such a case, and particularly for the hottest section 52 of the hotter gas duct, where the energy available is greatest, the energy of the hotter gas can be the sole means of propulsion of the intermediate fluid.

Figure 2:
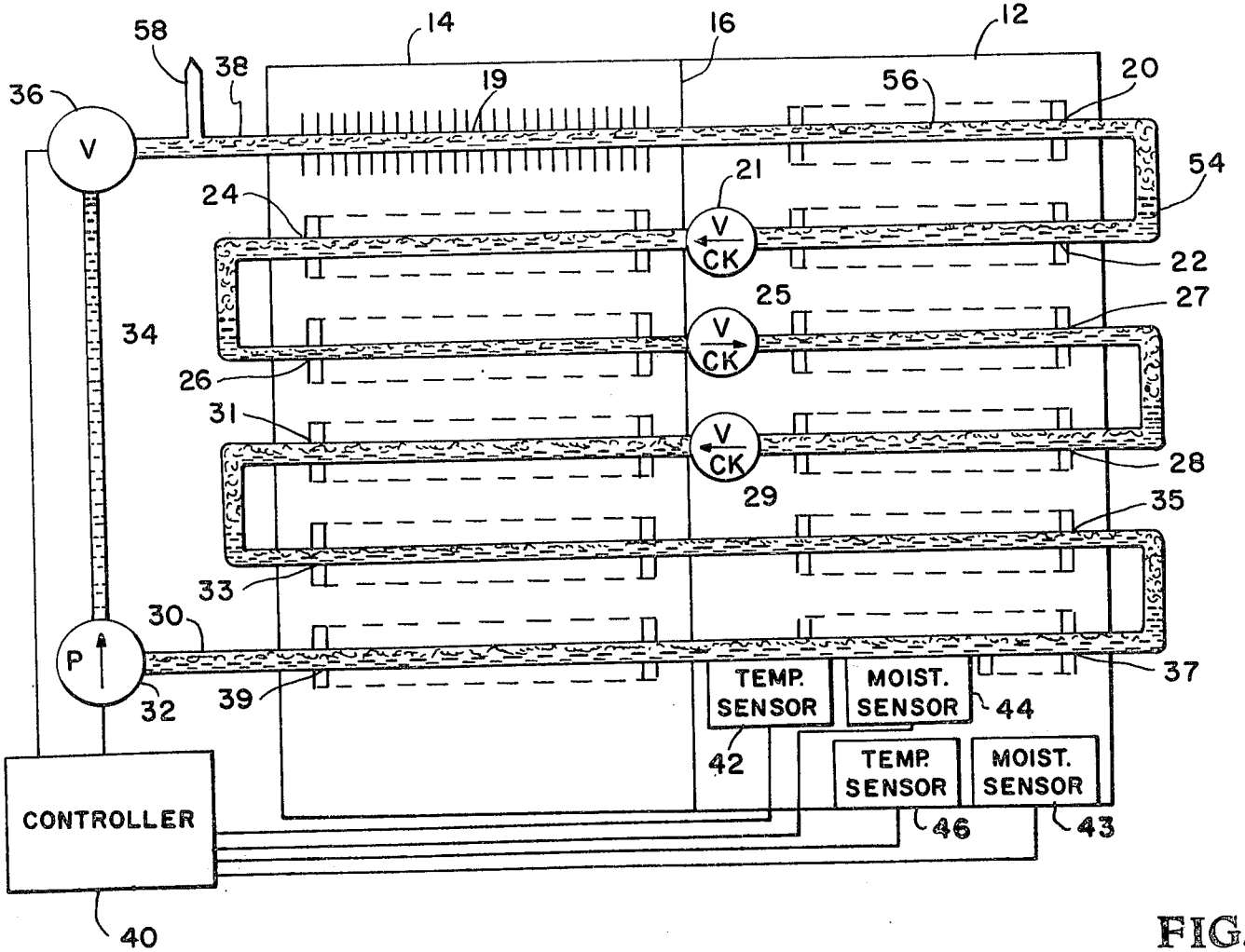
FIG. 2 is a simplified schematic view of a single section of heat exchanger used in the invention.

FIG. 2 is a simplified schematic drawing of a single section of a heat exchanger similar to that of FIG. 1, in which the gas flow is perpendicular to the plane of the paper, the number designations are the same as those in FIG. 1 for the same devices and some puddle flow of the intermediate fluid is shown within unit 19. As shown in FIG. 2 finned sections 20, 22, 27, 28 and the other sections in hotter gas duct 12 contain vapor and liquid mixture 54. This mixture moves back and forth between ducts 12 and 14 as it progresses from pipe 38 to pipe 30 and is evaporated into vapor 56 when in finned sections 20, 22, 27 and the other sections in duct 12. The repeated change from the vapor to liquid state and back, using the latent heat of vaporization, is the essential means of heat transfer between the two gases and yields particularly high overall efficiency, because little auxiliary power is required to move the small fluid volume resulting from the use of change of state heat transfer.

Several other particular advantages are available from the present invention. One is field serviceability and upgrading. The techniques required for filling the intermediate fluid paths through vacuum pipe and seal 58 are essentially those used in the refrigeration industry, so that the units can be shipped without intermediate fluid, and air can be removed from the pipes and intermediate fluid loaded at the installation site. This also permits changing intermediate fluid in the field if heat exchanger characteristics need to be upgraded or changed.

The system is also particularly advantageous for use in situations which require freeze resistance. A simple mixture of liquids, such as water and commercial anti-freeze compounds, operates perfectly well as the intermediate fluid. In such a case, the fluid with the higher vapor pressure transfers the greater amount of heat, and, if the vapor pressure difference is great enough, essentially operates as the fluid would without the added component. However, when the working fluid is in the liquid state the added anti-freeze compound travels along the path with it and prevents any possibility of freezing.

It is to be understood that the form of the invention herein shown is merely a preferred embodiment. Various changes may be made in the size, shape and the arrangement of parts; equivalent means may be substituted for those illustrated and described; and certain features may be used independently from others without departing from the spirit and scope of the invention as defined in the following claims. For example, the check valves can, in appropriate circumstances, such as gravity-aided flow, be eliminated to make the heat exchanger even simpler in construction.

What is claimed as new and desired to be secured by Letters Patent of the United States is:

1. A method of exchanging heat between two gases comprising:

moving a hotter gas through a first enclosure;

moving a cooler gas through a second enclosure which is isolated from the first enclosure;

partially filling an enclosed, closed loop path, from which non-condensible gases have been removed and which passes alternately, at least two times, between the hotter and cooler gases and includes heat exchanger means to transfer heat to and from both gases, with an intermediate fluid selected to vaporize at temperatures between the temperatures of the two gases; and circulating said intermediate fluid within said enclosed, closed loop path, thereby transferring heat from the hotter gas to the cooler gas by utilizing the latent heat of vaporization of the intermediate fluid.

2. A method of exchanging heat between two gases as in claim 1 comprising the additional step of controlling the flow of the intermediate fluid based upon the temperature of the intermediate fluid where it passes through the coolest portion of the hotter gas enclosure.

3. A method of exchanging heat between two gases as in claim 1 comprising the additional step of controlling the flow of the intermediate fluid based upon the detection of liquid in the coolest portion of the hotter gas enclosure.

4. A heat exchanger for transferring heat between two gases comprising:

a first enclosure through which a hotter gas is moved;

a second enclosure isolated from the first enclosure through which a cooler gas is moved;

an enclosed fluid path from which non-condensible gases have been removed passing alternately through the first and second enclosures at least two times, positioned within each enclosure transverse to the flow of the gas in the enclosure and including heat exchanger means to transfer heat between the gas in each enclosure and an intermediate fluid contained in the enclosed fluid path, and further including a vacuum pipe and seal means by which non-condensible gases can be removed;

an intermediate fluid partially filling the enclosed fluid path selected to vaporize between the temperatures of the hotter and cooler gases; and an enclosed fluid return means completing the fluid path and transporting the intermediate fluid from an exit point in one of the gas enclosures to an entry point in one of the gas enclosures thereby permitting the intermediate fluid to be continuously recycled through the heat exchanger.

5. A heat exchanger for transferring heat between two gases as in claim 4 further comprising additional independent enclosed fluid paths, including fluid return means, vacuum pipe and seal means and heat exchanger means, each containing an intermediate fluid selected to vaporize between the temperatures of the two gases to which the fluid path is subjected.

6. A heat exchanger for transferring heat between two gases as in claim 4 further comprising a control means which is capable of stopping the flow of the intermediate fluid through the fluid path.

7. A heat exchanger for transferring heat between two gases as in claim 6 further comprising a temperature sensing means connected to and activating the control means and attached to the enclosed fluid path at a location where the path passes through the coolest portion of the first gas enclosure.

8. A heat exchanger for transferring heat between two gases as in claim 6 further comprising a liquid sensing means connected to and activating the control means and attached to the interior of the first gas enclosure in its coolest area.

9. A heat exchanger for transferring heat between two gases as in claim 6 further comprising a liquid sensing means connected to and activating the control means and attached to the exterior of the enclosed fluid path at a location where it passes through the coolest portion of the first gas enclosure.

10. A heat exchanger for transferring heat between two gases as in claim 6 further comprising a temperature sensing means connected to and activating the control means and attached to the interior of the first gas enclosure in its coolest area.

11. A heat exchanger for transferring heat between two gases as in claim 4 wherein the fluid return means includes a mechanical pump.

12. A heat exchanger for transferring heat between two gases as in claim 4 wherein the fluid return means includes a vapor pump.

13. A heat exchanger for transferring heat between two gases as in claim 4 further comprising unidirectional flow means preventing intermediate fluid movement in the reverse direction.

* * * * *